United States Patent [19]

Obitz

[11] Patent Number: 5,040,736

[45] Date of Patent: Aug. 20, 1991

[54] DEVICE FOR REFINING CELLULOSE-CONTAINING MATERIAL

[75] Inventor: Lars O. Obitz, Waxholm, Sweden

[73] Assignee: Sunds Defibrator Industries Aktiebolag, Sweden

[21] Appl. No.: 566,260

[22] Filed: Aug. 13, 1990

[30] Foreign Application Priority Data

Sep. 19, 1989 [SE] Sweden ..... 8903070

[51] Int. Cl.[5] ..... B02C 23/02

[52] U.S. Cl. ..... 241/247; 241/248; 241/261.3; 162/261

[58] Field of Search ..... 241/244, 245, 246, 247, 241/248, 261.2, 261.3; 162/261

[56] References Cited

U.S. PATENT DOCUMENTS

| | | | |
|---|---|---|---|
| 3,765,611 | 10/1973 | Steinger | 241/118 |
| 3,893,631 | 7/1975 | Fisher et al. | 241/247 X |
| 3,984,057 | 10/1976 | Pilao | 241/261.3 X |
| 4,081,146 | 3/1978 | Yagi | 241/247 X |
| 4,269,365 | 5/1981 | Berggren | 241/261.2 X |
| 4,301,974 | 11/1981 | Sjobom . | |
| 4,378,092 | 3/1983 | Reinhall | 241/261.3 X |
| 4,457,804 | 7/1984 | Reinhall | 241/245 X |
| 4,657,636 | 4/1987 | Satomi | 162/261 |
| 4,725,336 | 2/1988 | Fisher | 162/261 |

FOREIGN PATENT DOCUMENTS

| | | | |
|---|---|---|---|
| 0172818 | 11/1987 | European Pat. Off. . | |
| 1361218 | 12/1987 | U.S.S.R. | 162/261 |

*Primary Examiner*—Mark Rosenbaum
*Assistant Examiner*—Frances S. Chin
*Attorney, Agent, or Firm*—Lerner, David, Littenberg, Krumholz & Mentlik

[57] ABSTRACT

Apparatus for refining lignocellulose containing material is disclosed, including a refiner housing including a pair of refiner discs relatively rotatable about a pair of rotatable shafts. Each refiner disc includes a refiner element mounted thereon in a face-to-face relationship defining a refiner gap therebetween. The apparatus includes feed passages passing through the first refiner discs at a location proximate to the rotatable shaft for feeding the lignocellulose-containing material to the refiner gap element and the first refiner disc includes feeding wings corresponding to the feed passages and located partially in front of each such feed passage to accelerate the lignocellulose-containing material into the refiner gap, while the second refiner disc includes a substantially smooth surface portion at a location juxtaposed with the location of the feed passages in the first refiner disc.

5 Claims, 2 Drawing Sheets

DEVICE FOR REFINING CELLULOSE-CONTAINING MATERIAL

FIELD OF THE INVENTION

The present invention relates to devices for refining cellulose-containing material, preferably in the form of chips. More particularly, the present invention relates to devices for refining cellulose-containing material in the form of so-called twin-disc refiners, namely where two counter-rotating refining discs are provided for refining the cellulose-containing material in the intermediate refining gap between the discs as the cellulose-containing material moves outwardly by the effect of centrifugal force.

BACKGROUND OF THE INVENTION

Conventional refiners of the twin-disc refiner type generally include means to supply the chips through openings adjacent to the center of one of the refining discs. During such feeding of the chips through these openings, the chips are accelerated up to the rotational speed of the refining disc which can be up to 1500 rpm. After these chips have passed well into the intermediate space between the refining discs, the chip fragments meet the counter-rotating refining disc with its refining elements. The object of these elements is to feed the chips out to the narrower portion of the refining gap where the actual refining takes place. However, due to the fact that the opposed refining disc is rotating at essentially the same speed in the opposite direction, problems can arise by the chips being decelerated thereby, and this further feeding of the chips through the openings in the refining disc, as well as movement of the chips outwardly toward the narrower portion of the refining gap, is rendered quite difficult.

SUMMARY OF THE INVENTION

In accordance with the present invention, the problems of the prior art have not been solved by providing a refining disc which contains the feed passages with feeding wings between the openings in the intermediate space between the two refining discs themselves, and by providing a smooth surface juxtaposed therewith on the opposed refining disc. In this manner the chips are not decelerated, but, in fact, are able to maintain their rotational movement as they are fed outwardly toward the narrower portion of the refining gap.

In accordance with a preferred embodiment of the present invention, there is thus provided an apparatus for refining lignocellulose-containing material which includes a housing, a first rotatable shaft, a first refiner disc mounted on the first rotatable shaft, a first refining element mounted on the first refiner disc, a second rotatable shaft, a second refining disc mounted on the second rotatable shaft, a second refiner element mounted on the second refiner disc, the first and second refiner discs being mounted for relative rotation with respect to each other in opposite directions with the first and second refiner elements in face-to-face relationship thereby defining a refiner gap therebetween, feed means for feeding the ligno-cellulose containing material to the refiner gap, the feed means including a plurality of feed passages passing through the first refiner disc into the refiner gap at a location proximate to the first rotatable shaft for passage outwardly through the refiner gap, the first refiner disc including a plurality of feeding wings corresponding to the plurality of feed passages, with each of the plurality of feeding wings being located at least partially in front of each of the corresponding plurality of feed passages so as to accelerate the ligno-cellulose containing material passing through the plurality of feed passages into the refiner gap, and the second refiner disc including a substantially smooth surface portion at a location juxtaposed with the location of the plurality of feed passages in the first refiner disc.

In accordance with a preferred embodiment of the apparatus of the present invention, the apparatus includes an annular plate member mounted on the first refiner disc, with the plurality of feeding rings being mounted on the annular plate member.

In accordance with another embodiment of the apparatus of the present invention, an annular ring member is mounted on the second refiner disc, the annular ring member including a substantially smooth surface portion. In a preferred embodiment the apparatus includes four feed passages and four feeding wings corresponding thereto. Preferably, the feeding wings include wing portions including a portion extending substantially perpendicularly from the first refiner disc.

BRIEF DESCRIPTION OF THE DRAWINGS

The present invention is described in more detail in the following detailed description, which can be further understood with reference to the accompanying Figures, in which.

DETAILED DESCRIPTION

Figure 1:
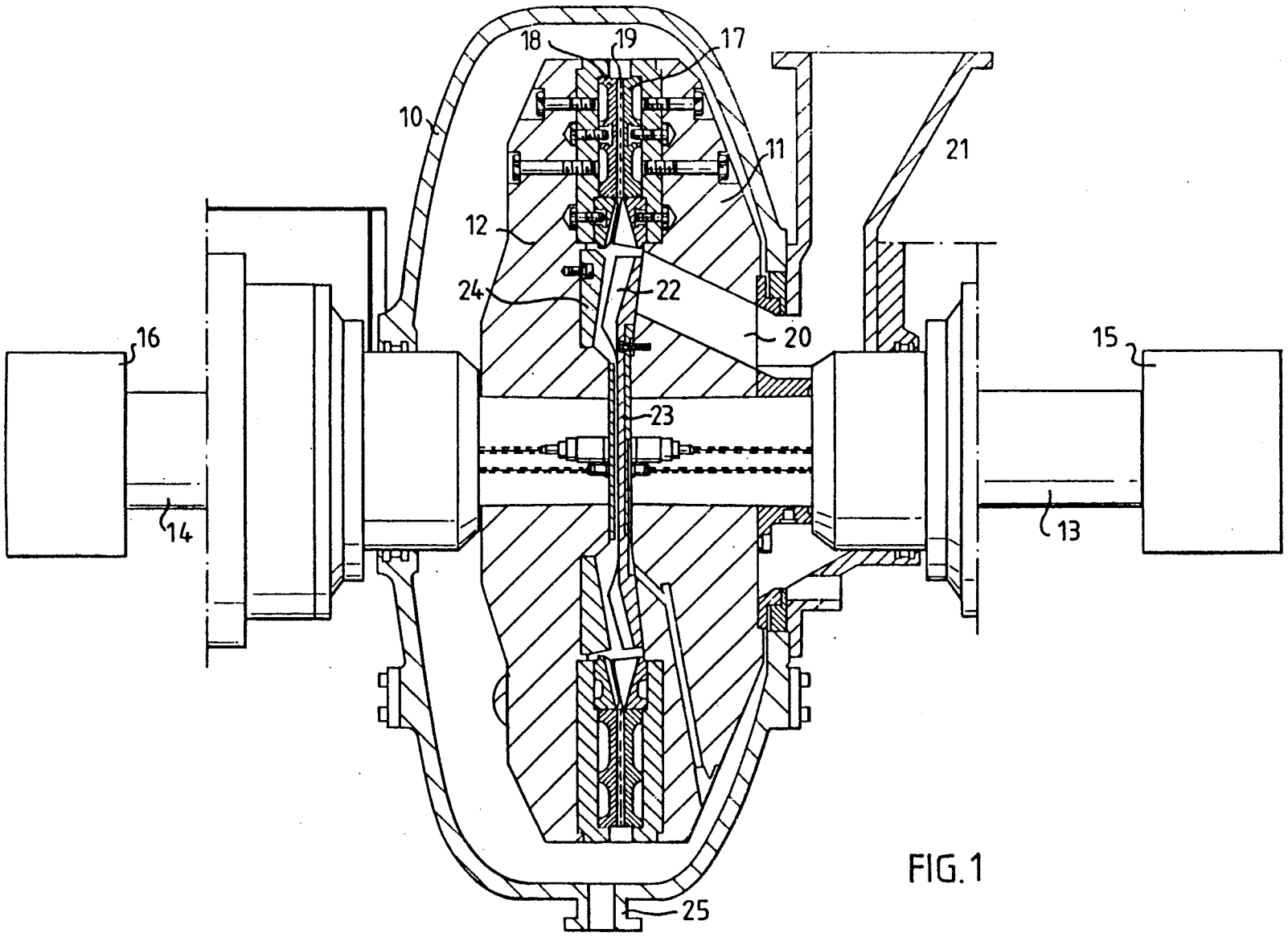
FIG. 1 is an elevational, partial cross-sectional view of the refining apparatus in accordance with the present invention.
Figure 3:
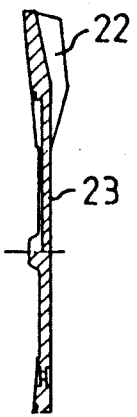
FIG. 3 is a partial, side, sectional view of the refining disc shown in FIG. 2 taken along section A—A thereof.
Figure 2:
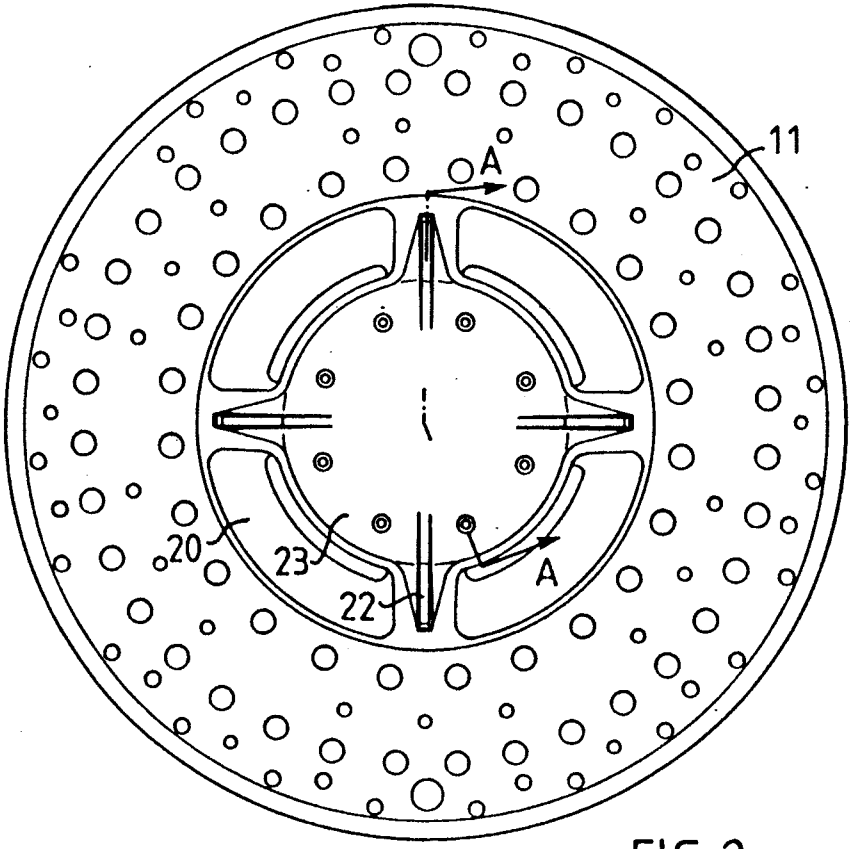
FIG. 2 is a front, elevational view of the face of a refining disc in accordance with the present invention.

Referring to the Figures, in which like numerals refer to like portions thereof, the refining apparatus according to the present invention includes a refiner housing 10 within which are first and second refining discs 11 and 12, respectively, which are each attached to a shaft 13 and 14, respectively, and which are rotatable in opposed directions by means of motors 15 and 16, respectively.

On the front sides of the refining discs 11 facing toward each other are refining elements 17 and 18. Refining elements 17 and 18 form a refining gap 19 therebetween, through which the lignocellulose-containing material is intended to move outwardly while simultaneously being processed and refined.

The first refining disc 11 is provided with at least two, and preferably four, openings 20 which are located close to the shaft 13. There openings extend through refining disc 11 from its rear side to its front side, and are directed obliquely outward from the shaft 13. The chips to be refined are supplied from a feeder 21 to the feed openings in the first refining disc 11.

On the front side of the first refining disc 11, feeding wings 22 are located between the openings 20 inwardly from the refining elements 17. These feeding wings 22 are directed substantially radially, and are preferably attached to an annular plate 23, which in turn is attached to the refining disc itself. The front side of the second refining disc 12 is substantially smooth at a location directly in front of the openings 20. This smooth portion of the second refining disc preferably consists of a smooth ring 24 attached to this refining disc.

The chips are thus fed in through the feed openings and are accelerated up to the speed of the refining disc 11 when they pass through that refining disc. When they are discharged from the feed openings on the front side of the refining disc 11, the chips are thrown outwardly by the feeding wings 22 without being braked by the counter-rotating refining disc 12, which is smooth directly in front of these feed openings. In this manner, a continuous and uniform flow outwardly to the refining gap 19 is ensured, also resulting in a uniform quality of the refined pulp.

The refined pulp passing out through the refining gap 19 is then collected in the refiner housing 10, and discharged through an outlet 25.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for refining lignocellulose-containing material comprising a first rotatable shaft, a first refiner disc mounted on said first rotatable shaft, a first refining element mounted on said first refiner disc, a second rotatable shaft, a second refiner disc mounted on said second rotatable shaft, a second refiner element mounted on said second refiner disc, said first and second refiner discs being mounted for relative rotation with respect to each other in opposite directions with said first and second refiner elements in face-to-face relationship thereby defining a refiner gap therebetween, feed means for feeding said lignocellulose-containing material to said refiner gap, said feed means including a plurality of feed passages passing through said first refiner disc into said refiner gap at a location proximate to said first rotatable shaft for passage outwardly through said refiner gap, said first refiner disc including a plurality of feeding wings corresponding to said plurality of feed passages, with each of said plurality of feeding winds being located at least partially in front of each of said corresponding plurality of feed passages so as to accelerate said lignocellulose-containing material passing through said plurality of feed passages into said refiner gap, and said second refiner disc including a substantially smooth surface portion at a location thereon juxtaposed with said location of said plurality of feed passages in said first refiner disc.

2. The apparatus of claim 1 including an annular plate member mounted on said first refiner disc, said plurality of feeding wings being mounted on said annular plate member.

3. The apparatus of claim 1 including an annular ring member mounted on said second refiner disc, said annular ring member including said substantially smooth surface portion.

4. The apparatus of claim 1 including four of said feed passages and four of said feeding wings corresponding thereto.

5. The apparatus of claim 1 wherein said feeding wings include wing portions including a portion extending substantially perpendicular from said first refiner disc.

* * * * *

UNITED STATES PATENT AND TRADEMARK OFFICE

CERTIFICATE OF CORRECTION

PATENT NO. : 5,040,736

DATED : August 20, 1991

INVENTOR(S) : Obitz

It is certified that error appears in the above-identified patent and that said Letters Patent is hereby corrected as shown below:

Column 2, line 56, "There" should read --These--.

Column 4, line 11, "winds" should read --wings--.

Signed and Sealed this

Ninth Day of March, 1993

*Attest:*

STEPHEN G. KUNIN

*Attesting Officer*

*Acting Commissioner of Patents and Trademarks*